US009708990B2

(12) United States Patent
Dudar

(10) Patent No.: US 9,708,990 B2
(45) Date of Patent: Jul. 18, 2017

(54) SYSTEM AND METHODS FOR FUEL VAPOR CANISTER FLOW

(71) Applicant: Ford Global Technologies, LLC, Dearborn, MI (US)

(72) Inventor: Aed M. Dudar, Canton, MI (US)

(73) Assignee: Ford GLobal Technologies, LLC, Dearborn, MI (US)

( * ) Notice: Subject to any disclaimer, the term of this patent is extended or adjusted under 35 U.S.C. 154(b) by 121 days.

(21) Appl. No.: 14/843,371

(22) Filed: Sep. 2, 2015

(65) Prior Publication Data

US 2017/0058799 A1 Mar. 2, 2017

(51) Int. Cl.

| | |
|---|---|
| ***F02M 25/08*** | (2006.01) |
| ***F02M 33/02*** | (2006.01) |
| ***F02D 41/00*** | (2006.01) |

(52) U.S. Cl.

CPC ..... *F02D 41/0032* (2013.01); *F02M 25/089* (2013.01); *F02M 25/0809* (2013.01); *F02M 25/0836* (2013.01); *F02M 25/0854* (2013.01)

(58) Field of Classification Search

CPC ..... F02M 25/0809; F02M 25/0818; F02M 25/089; F02M 25/0836; F02M 25/0854; F02M 25/0872; F02D 41/0037; F02D 41/003; F02D 41/0035; F02D 41/004; F02D 41/0032; F02D 41/0042; F02D 19/025; F02D 19/0621; F02D 19/0623; F02D 2041/224; F02D 2041/225; F02D 2041/222

USPC ..... 123/520, 198 D, 521, 519, 516, 518; 73/114.39, 114.38; 701/107

See application file for complete search history.

(56) References Cited

U.S. PATENT DOCUMENTS

| | | | | |
|---|---|---|---|---|
| 6,537,354 | B2 | 3/2003 | Meiller et al. | |
| 2004/0040547 | A1 | 3/2004 | Ivens et al. | |
| 2010/0288021 | A1 | 11/2010 | Makino et al. | |
| 2012/0138023 | A1* | 6/2012 | Lee | F02M 25/0854 123/521 |
| 2014/0123962 | A1* | 5/2014 | Ide | F02M 25/089 123/520 |
| 2014/0209069 | A1* | 7/2014 | Peters | F02M 25/0809 123/520 |
| 2014/0216421 | A1 | 8/2014 | Pifher et al. | |
| 2014/0311461 | A1* | 10/2014 | Dudar | F02M 25/0818 123/520 |
| 2015/0019066 | A1* | 1/2015 | Dudar | F02M 25/0809 701/29.7 |
| 2015/0361929 | A1* | 12/2015 | Tamura | F02M 25/0809 73/114.39 |

(Continued)

*Primary Examiner* — Hai Huynh
*Assistant Examiner* — George Jin
(74) *Attorney, Agent, or Firm* — James Dottavio; McCoy Russell LLP

(57) ABSTRACT

Methods and systems are provided for regulating the flow of fuel vapor in an evaporative emissions system. In one example, a method may include re-routing fuel tank vapors responsive to an indication of a leaky canister purge valve such that fuel tank vapors may be efficiently adsorbed by a fuel vapor canister during engine-off conditions, rather than bypassing the fuel vapor canister and being released to the atmosphere. In this way, evaporative emissions may be prevented during the duration of time following an indication of a leaky canister purge valve and servicing the vehicle.

20 Claims, 6 Drawing Sheets

(56) References Cited

U.S. PATENT DOCUMENTS

2016/0369722 A1* 12/2016 Wakamatsu ..... F02D 41/0032

* cited by examiner

SYSTEM AND METHODS FOR FUEL VAPOR CANISTER FLOW

FIELD

The present description relates generally to methods and systems for controlling a vehicle engine to regulate the flow of fuel vapor in response to an indication of a leaky canister purge valve.

BACKGROUND/SUMMARY

Vehicle evaporative emission control systems may be configured to store fuel vapors from fuel tank refueling and diurnal engine operations in a fuel vapor canister, and then purge the stored vapors during a subsequent engine operation. The stored vapors may be routed to engine intake for combustion, further improving fuel economy.

In a typical canister purge operation, a canister purge valve (CPV) coupled between the engine intake and the fuel canister is opened, allowing for intake manifold vacuum to be applied to the fuel canister. Simultaneously, a canister vent valve (CVV) coupled between the fuel canister and atmosphere is opened, allowing for fresh air to enter the canister. This configuration facilitates desorption of stored fuel vapors from the adsorbent material in the canister, regenerating the adsorbent material for further fuel vapor adsorption.

Diagnostics may be performed on the evaporative emission control system, e.g., to detect leaks in the system. Leak diagnostics may be based on pressure or vacuum changes in one or more components of the emissions control system during certain conditions. A common leak path in the emission control system is through the CPV, the result of canister carbon dust accumulation and sealing surface deterioration.

Responsive to an indication of a leaky CPV, mitigating action may be taken restore CPV functionality. For example US Patent Application No. 2014/0311461 A1 teaches under vacuum conditions, opening the CPV and generating pressure pulsations in a conduit coupled to the CPV while maintaining the CPV open such that contaminants may be dislodged and evacuated to the intake manifold. However, the inventors herein have recognized potential issues with such a method. In particular, in situations wherein a leaky CPV is still detected subsequent to mitigating action, considerable time may pass prior to the vehicle being serviced to repair the leaky CPV. During this period of time, when the engine is off, the travel path of least resistance for fuel tank vapor may be from the fuel tank to atmosphere via the leaky CPV. As such, fuel tank vapors may bypass the majority of the vapor canister, traveling instead through a small buffer area prior to exiting to the atmosphere via the leaky CPV. As the majority of the canister is bypassed as a result of the leaky CPV, adsorption is not optimal and increased emissions may result.

Thus, the inventors herein have developed systems and methods to at least partially address the above issues. In one example, a method is provided comprising, when an engine is off, routing fuel vapors from a fuel tank into a vapor adsorbent and venting said vapor adsorbent to atmosphere; when said engine is operating, venting said vapor adsorbent to atmosphere, and routing vapors from said fuel tank through a purge valve, and desorbed vapors from said vapor adsorbent through said purge valve, into said engine for combustion; and when said purge valve is detected as leaking and said engine is turned off, turning off said purge valve, isolating said canister form atmosphere, and re-routing said vapors in said tank first through said vapor adsorbent and then to said purge valve. In this way, responsive to an indication of a leak in said purge valve, fuel tank vapors may be routed such that vapors may first travel through the vapor canister where they may be efficiently adsorbed, en route to engine intake via the leaky CPV prior to exiting to atmosphere.

In one example, re-routing said vapors in said tank through said canister and to said purge valve includes changing a position of a first two-way valve positioned between a canister vent port and a canister vent valve, changing a position of a second two-way valve positioned between a canister purge port and said purge valve, and closing said canister vent valve. As such, responsive to an engine-off event wherein a leak in the purge valve is indicated, by changing the position of said first and second two-way valves, and closing said canister vent valve, fuel tank vapors may be prevented from traveling from said fuel tank to engine intake prior to being adsorbed by said vapor canister. In this way, responsive to an indication of a leaky purge valve, excessive release of fuel tank vapor to the atmosphere may be prevented during engine-off conditions.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 4:
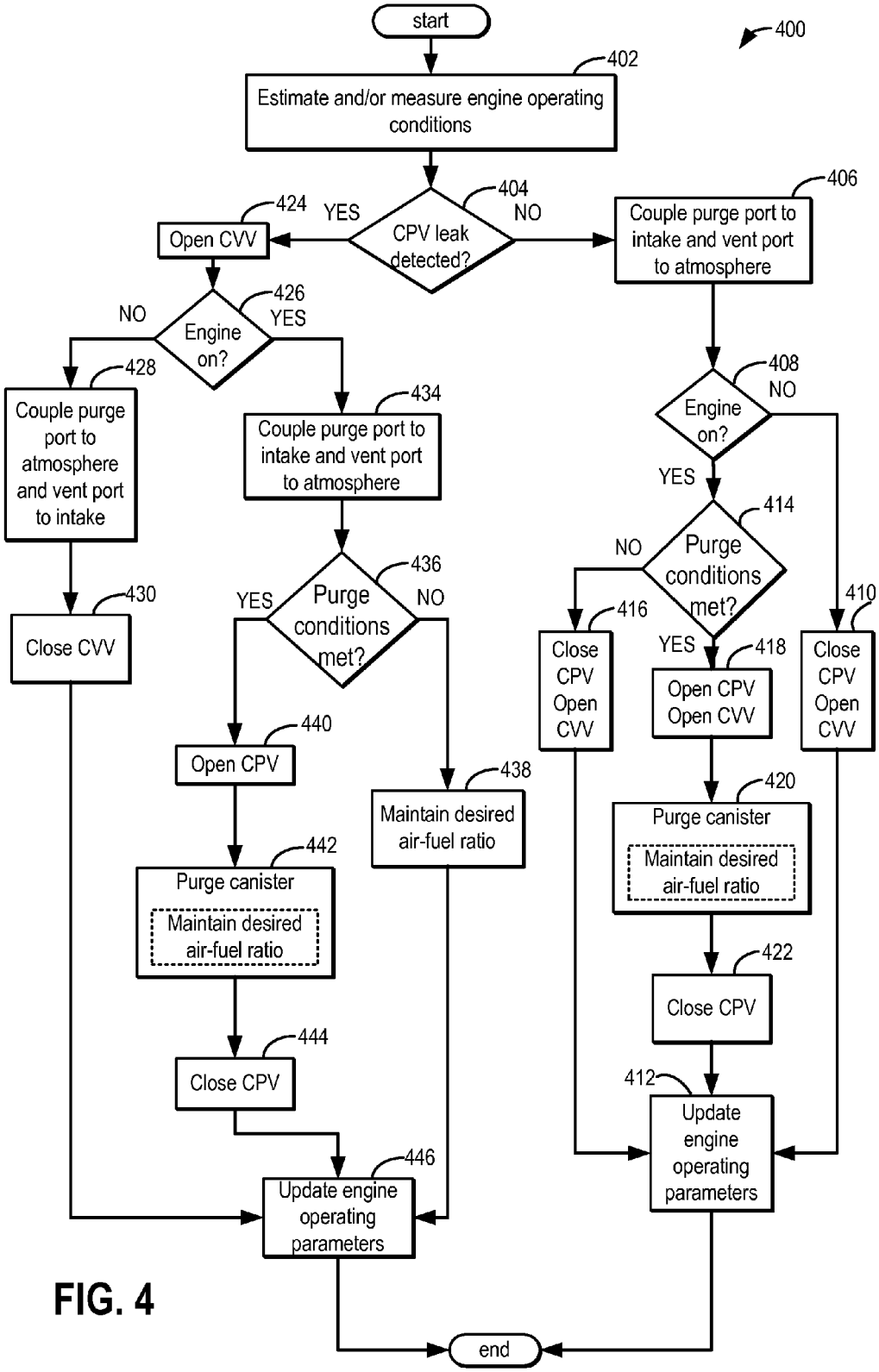
FIG. 4 shows a high level flow-chart for a method for operating a vehicle evaporative emissions system based on engine operating conditions using the systems of FIGS. 1-3D.
Figure 5:
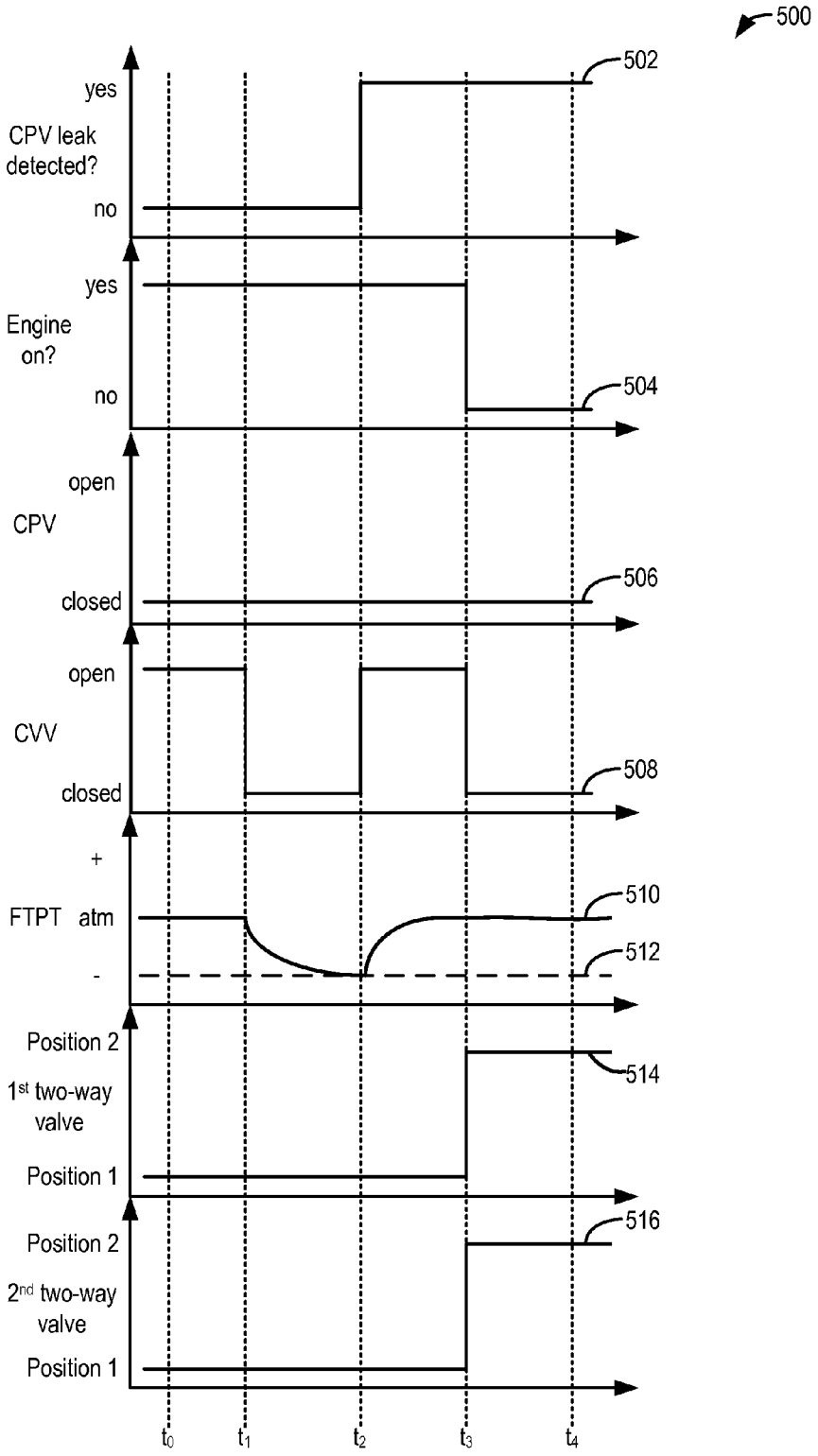
FIG. 5 shows an example timeline for preventing evaporative emissions responsive to an indication of a canister purge valve leak using the method of FIG. 4.

This detailed description relates to systems and method for managing fuel vapor in an evaporative emissions system. In particular, the description relates to re-routing the path of fuel tank vapor travel responsive to an indication of canister purge valve leak. The evaporative emissions system may be included in a hybrid vehicle, such as the hybrid vehicle system depicted in FIG. 1. The vehicle may include an engine system and fuel system coupled to the evaporative emissions system, as shown in FIG. 2. The evaporative emissions system may include a fuel vapor canister coupled to a fuel tank such that fuel vapor may be discharged from the fuel tank and stored in the vapor canister without entering the atmosphere. The stored fuel vapor may be purged to intake with fresh air drawn from the atmosphere. FIGS. 3A-3D show depictions of an example fuel vapor canister and a system of conduits and valves for controlling the direction of fuel tank vapor travel based on operating conditions. A method for operating a vehicle evaporative emissions system based on engine operating conditions is depicted in FIG. 4. The method includes re-routing fuel tank vapor travel responsive to an indicated leak in a canister purge valve during engine off conditions such that evaporative emissions may be prevented. FIG. 5 shows an example timeline for vehicle operation using the method of FIG. 4.

Figure 1:
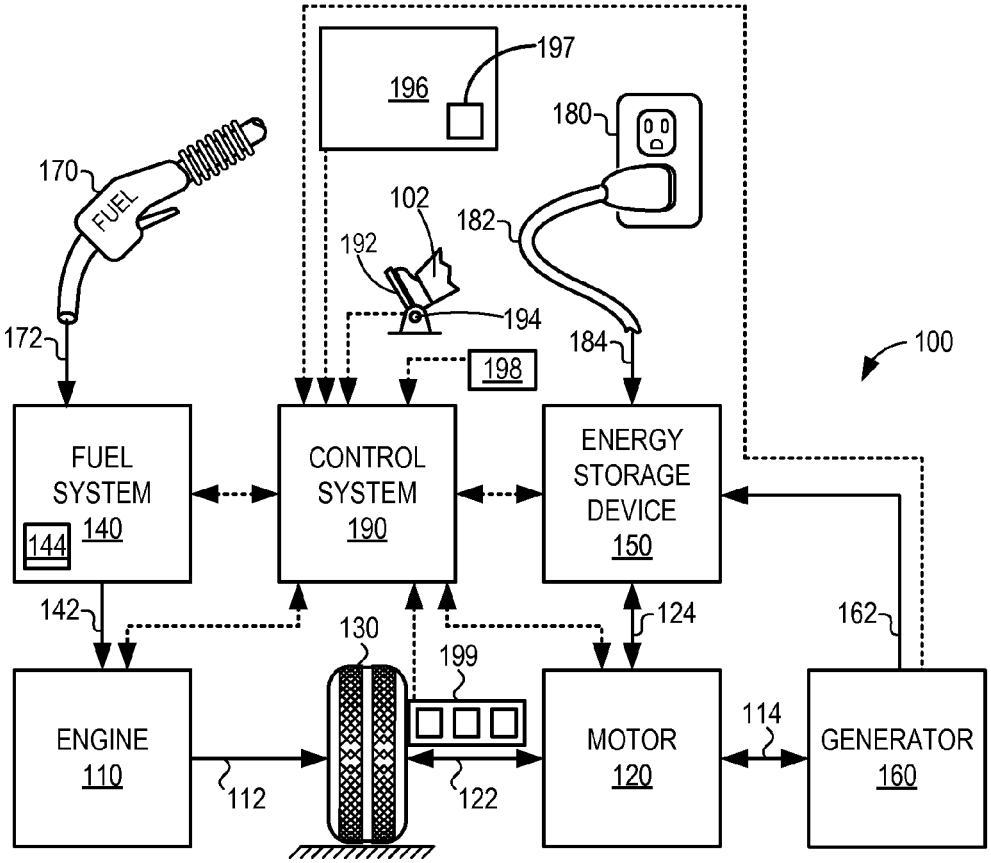
FIG. 1 schematically shows an example vehicle propulsion system.
Figure 2:
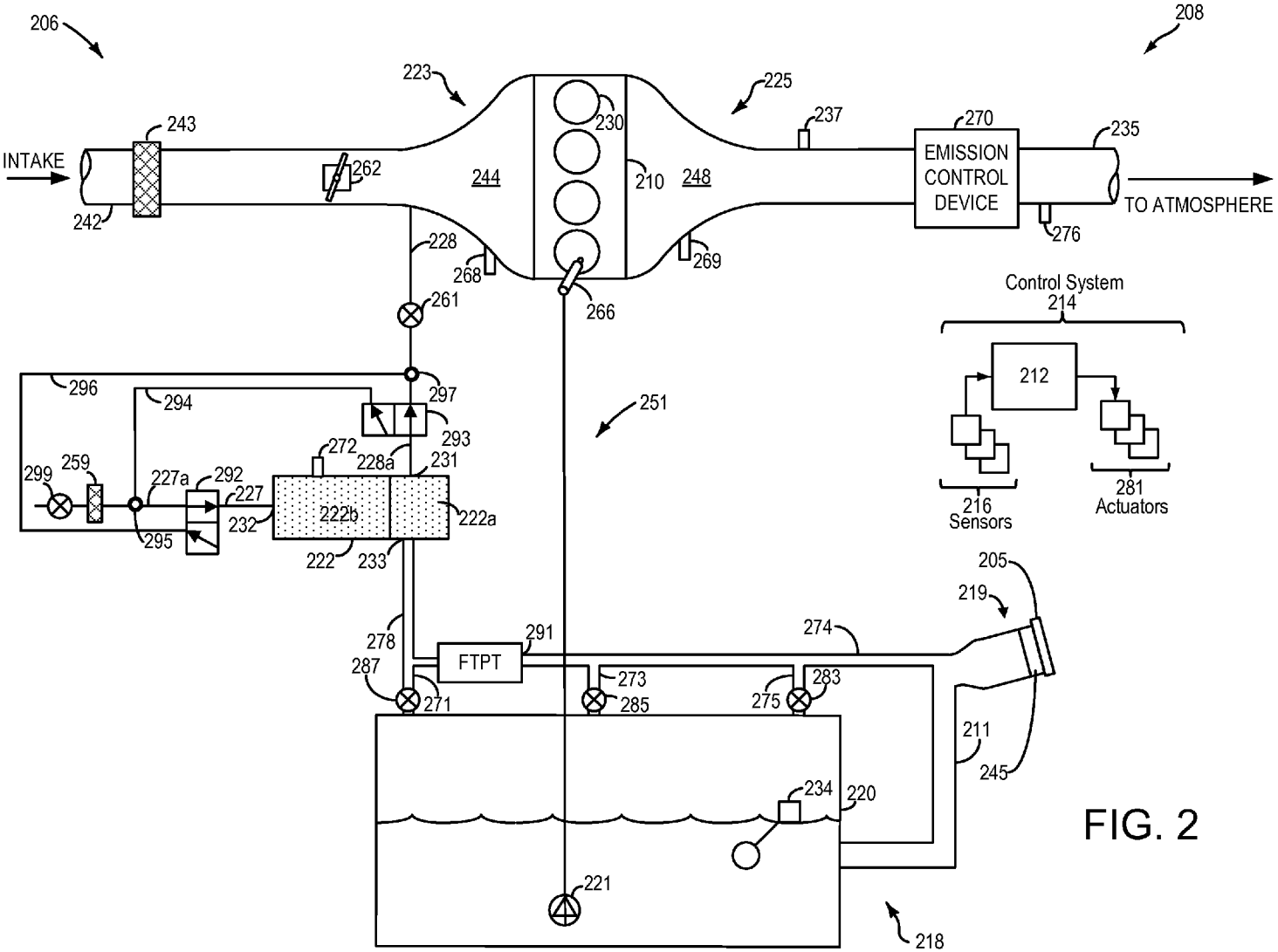
FIG. 2 schematically shows an example vehicle system with a fuel system and an evaporative emissions system.

FIG. 1 illustrates an example vehicle propulsion system 100. Vehicle propulsion system 100 includes a fuel burning engine 110 and a motor 120. As a non-limiting example, engine 110 comprises an internal combustion engine and motor 120 comprises an electric motor. Motor 120 may be configured to utilize or consume a different energy source than engine 110. For example, engine 110 may consume a liquid fuel (e.g., gasoline) to produce an engine output while motor 120 may consume electrical energy to produce a motor output. As such, a vehicle with propulsion system 100 may be referred to as a hybrid electric vehicle (HEV).

Vehicle propulsion system 100 may utilize a variety of different operational modes depending on operating conditions encountered by the vehicle propulsion system. Some of these modes may enable engine 110 to be maintained in an off state (set to a deactivated state) where combustion of fuel at the engine is discontinued. For example, under select operating conditions, motor 120 may propel the vehicle via drive wheel 130 as indicated by arrow 122 while engine 110 is deactivated.

During other operating conditions, engine 110 may be set to a deactivated state (as described above) while motor 120 may be operated to charge energy storage device 150. For example, motor 120 may receive wheel torque from drive wheel 130 as indicated by arrow 122 where the motor may convert the kinetic energy of the vehicle to electrical energy for storage at energy storage device 150 as indicated by arrow 124. This operation may be referred to as regenerative braking of the vehicle. Thus, motor 120 can provide a generator function in some embodiments. However, in other embodiments, generator 160 may instead receive wheel torque from drive wheel 130, where the generator may convert the kinetic energy of the vehicle to electrical energy for storage at energy storage device 150 as indicated by arrow 162.

During still other operating conditions, engine 110 may be operated by combusting fuel received from fuel system 140 as indicated by arrow 142. For example, engine 110 may be operated to propel the vehicle via drive wheel 130 as indicated by arrow 112 while motor 120 is deactivated. In some examples, fuel delivery to engine 110 from fuel system 140 may be adjusted in response to an indication of engine exhaust air/fuel ratio to maintain an overall stoichiometric mixture of air, fuel from the fuel tank, vapors from the fuel tank, and desorbed vapors from a vapor canister (see FIG. 2). During other operating conditions, both engine 110 and motor 120 may each be operated to propel the vehicle via drive wheel 130 as indicated by arrows 112 and 122, respectively. A configuration where both the engine and the motor may selectively propel the vehicle may be referred to as a parallel type vehicle propulsion system. Note that in some embodiments, motor 120 may propel the vehicle via a first set of drive wheels and engine 110 may propel the vehicle via a second set of drive wheels.

In other embodiments, vehicle propulsion system 100 may be configured as a series type vehicle propulsion system, whereby the engine does not directly propel the drive wheels. Rather, engine 110 may be operated to power motor 120, which may in turn propel the vehicle via drive wheel 130 as indicated by arrow 122. For example, during select operating conditions, engine 110 may drive generator 160, which may in turn supply electrical energy to one or more of motor 120 as indicated by arrow 114 or energy storage device 150 as indicated by arrow 162. As another example, engine 110 may be operated to drive motor 120 which may in turn provide a generator function to convert the engine output to electrical energy, where the electrical energy may be stored at energy storage device 150 for later use by the motor.

Fuel system 140 may include one or more fuel storage tanks 144 for storing fuel on-board the vehicle. For example, fuel tank 144 may store one or more liquid fuels, including but not limited to: gasoline, diesel, and alcohol fuels. In some examples, the fuel may be stored on-board the vehicle as a blend of two or more different fuels. For example, fuel tank 144 may be configured to store a blend of gasoline and ethanol (e.g., E10, E85, etc.) or a blend of gasoline and methanol (e.g., M10, M85, etc.), whereby these fuels or fuel blends may be delivered to engine 110 as indicated by arrow 142. Still other suitable fuels or fuel blends may be supplied to engine 110, where they may be combusted at the engine to produce an engine output. The engine output may be utilized to propel the vehicle as indicated by arrow 112 or to recharge energy storage device 150 via motor 120 or generator 160.

In some embodiments, energy storage device 150 may be configured to store electrical energy that may be supplied to other electrical loads residing on-board the vehicle (other than the motor), including cabin heating and air conditioning, engine starting, headlights, cabin audio and video systems, etc. As a non-limiting example, energy storage device 150 may include one or more batteries and/or capacitors.

Control system 190 may communicate with one or more of engine 110, motor 120, fuel system 140, energy storage device 150, and generator 160. Control system 190 may receive sensory feedback information from one or more of engine 110, motor 120, fuel system 140, energy storage device 150, and generator 160. Further, control system 190 may send control signals to one or more of engine 110, motor 120, fuel system 140, energy storage device 150, and generator 160 responsive to this sensory feedback. Control system 190 may receive an indication of an operator requested output of the vehicle propulsion system from a vehicle operator 102. For example, control system 190 may receive sensory feedback from pedal position sensor 194 which communicates with pedal 192. Pedal 192 may refer schematically to a brake pedal and/or an accelerator pedal.

Energy storage device 150 may periodically receive electrical energy from a power source 180 residing external to the vehicle (e.g., not part of the vehicle) as indicated by arrow 184. As a non-limiting example, vehicle propulsion system 100 may be configured as a plug-in hybrid electric vehicle (HEV), whereby electrical energy may be supplied to energy storage device 150 from power source 180 via an electrical energy transmission cable 182. During a recharging operation of energy storage device 150 from power source 180, electrical transmission cable 182 may electrically couple energy storage device 150 and power source 180. While the vehicle propulsion system is operated to propel the vehicle, electrical transmission cable 182 may disconnected between power source 180 and energy storage device 150. Control system 190 may identify and/or control the amount of electrical energy stored at the energy storage device, which may be referred to as the state of charge (SOC).

In other embodiments, electrical transmission cable 182 may be omitted, where electrical energy may be received wirelessly at energy storage device 150 from power source 180. For example, energy storage device 150 may receive electrical energy from power source 180 via one or more of electromagnetic induction, radio waves, and electromagnetic resonance. As such, it may be appreciated that any suitable approach may be used for recharging energy storage device 150 from a power source that does not comprise part of the vehicle. In this way, motor 120 may propel the vehicle by utilizing an energy source other than the fuel utilized by engine 110.

Fuel system 140 may periodically receive fuel from a fuel source residing external to the vehicle. As a non-limiting example, vehicle propulsion system 100 may be refueled by receiving fuel via a fuel dispensing device 170 as indicated by arrow 172. In some embodiments, fuel tank 144 may be configured to store the fuel received from fuel dispensing device 170 until it is supplied to engine 110 for combustion. In some embodiments, control system 190 may receive an indication of the level of fuel stored at fuel tank 144 via a fuel level sensor. The level of fuel stored at fuel tank 144 (e.g., as identified by the fuel level sensor) may be communicated to the vehicle operator, for example, via a fuel gauge or indication in a vehicle instrument panel 196.

The vehicle propulsion system 100 may also include an ambient temperature/humidity sensor 198, and a roll stability control sensor, such as a lateral and/or longitudinal and/or yaw rate sensor(s) 199. The vehicle instrument panel 196 may include indicator light(s) and/or a text-based display in which messages are displayed to an operator. The vehicle instrument panel 196 may also include various input portions for receiving an operator input, such as buttons, touch screens, voice input/recognition, etc. For example, the vehicle instrument panel 196 may include a refueling button 197 which may be manually actuated or pressed by a vehicle operator to initiate refueling. For example, in response to the vehicle operator actuating refueling button 197, a fuel tank in the vehicle may be depressurized so that refueling may be performed.

In an alternative embodiment, the vehicle instrument panel 196 may communicate audio messages to the operator without display. Further, the sensor(s) 199 may include a vertical accelerometer to indicate road roughness. These devices may be connected to control system 190. In one example, the control system may adjust engine output and/or the wheel brakes to increase vehicle stability in response to sensor(s) 199.

FIG. 2 shows a schematic depiction of a vehicle system 206. The vehicle system 206 includes an engine system 208 coupled to an emissions control system 251 and a fuel system 218. Emission control system 251 includes a fuel vapor container or canister 222 which may be used to capture and store fuel vapors. In some examples, vehicle system 206 may be a hybrid electric vehicle system.

The engine system 208 may include an engine 210 having a plurality of cylinders 230, or combustion chambers. The engine 210 includes an engine intake 223 and an engine exhaust 225. The engine intake 223 includes a throttle 262 fluidly coupled to the engine intake manifold 244 via an intake passage 242. Intake air may enter intake manifold 244 via one or more air filters 243. The engine exhaust 225 includes an exhaust manifold 248 leading to an exhaust passage 235 that routes exhaust gas to the atmosphere. The engine exhaust 225 may include one or more emission control devices 270, which may be mounted in a close-coupled position in the exhaust. One or more emission control devices may include a three-way catalyst, lean NOx trap, diesel particulate filter, oxidation catalyst, etc. It will be appreciated that other components may be included in the engine such as a variety of valves and sensors.

Fuel system 218 may include a fuel tank 220 coupled to a fuel pump system 221. The fuel pump system 221 may include one or more pumps for pressurizing fuel delivered to the injectors of engine 210, such as the example injector 266 shown. While only a single injector 266 is shown, additional injectors are provided for each cylinder. It will be appreciated that fuel system 218 may be a return-less fuel system, a return fuel system, or various other types of fuel system. Fuel tank 220 may hold a plurality of fuel blends, including fuel with a range of alcohol concentrations, such as various gasoline-ethanol blends, including E10, E85, gasoline, etc., and combinations thereof. A fuel level sensor 234 located in fuel tank 220 may provide an indication of the fuel level ("Fuel Level Input") to controller 212. As depicted, fuel level sensor 234 may comprise a float connected to a variable resistor. Alternatively, other types of fuel level sensors may be used.

Vapors generated in fuel system 218 may be routed to an evaporative emissions control system 251 which includes a fuel vapor canister 222 via vapor recovery line 274, before being purged to the engine intake 223. Vapor recovery line 274 may be coupled to fuel tank 220 via one or more conduits and may include one or more valves for isolating the fuel tank during certain conditions. For example, vapor recovery line 274 may be coupled to fuel tank 220 via one or more or a combination of conduits 271, 273, and 275.

Further, in some examples, one or more fuel tank vent valves in conduits 271, 273, or 275. Among other functions, fuel tank vent valves may allow a fuel vapor canister of the emissions control system to be maintained at a low pressure or vacuum without increasing the fuel evaporation rate from the tank (which would otherwise occur if the fuel tank pressure were lowered). For example, conduit 271 may include a grade vent valve (GVV) 287, conduit 273 may include a fill limit venting valve (FLVV) 285, and conduit 275 may include a grade vent valve (GVV) 283. Further, in some examples, recovery line 274 may be coupled to a fuel filler system 219. In some examples, fuel filler system may include a fuel cap 205 for sealing off the fuel filler system from the atmosphere. Refueling system 219 is coupled to fuel tank 220 via a fuel filler pipe or neck 211.

Further, refueling system 219 may include refueling lock 245. In some embodiments, refueling lock 245 may be a fuel cap locking mechanism. The fuel cap locking mechanism may be configured to automatically lock the fuel cap in a closed position so that the fuel cap cannot be opened. For example, the fuel cap 205 may remain locked via refueling lock 245 while pressure or vacuum in the fuel tank is greater than a threshold. In response to a refuel request, e.g., a vehicle operator initiated request, the fuel tank may be depressurized and the fuel cap unlocked after the pressure or vacuum in the fuel tank falls below a threshold. A fuel cap locking mechanism may be a latch or clutch, which, when engaged, prevents the removal of the fuel cap. The latch or clutch may be electrically locked, for example, by a solenoid, or may be mechanically locked, for example, by a pressure diaphragm.

In some embodiments, refueling lock 245 may be a filler pipe valve located at a mouth of fuel filler pipe 211. In such embodiments, refueling lock 245 may not prevent the removal of fuel cap 205. Rather, refueling lock 245 may prevent the insertion of a refueling pump into fuel filler pipe 211. The filler pipe valve may be electrically locked, for example by a solenoid, or mechanically locked, for example by a pressure diaphragm.

In some embodiments, refueling lock 245 may be a refueling door lock, such as a latch or a clutch which locks a refueling door located in a body panel of the vehicle. The refueling door lock may be electrically locked, for example by a solenoid, or mechanically locked, for example by a pressure diaphragm.

In embodiments where refueling lock 245 is locked using an electrical mechanism, refueling lock 245 may be unlocked by commands from controller 212, for example, when a fuel tank pressure decreases below a pressure threshold. In embodiments where refueling lock 245 is locked using a mechanical mechanism, refueling lock 245 may be unlocked via a pressure gradient, for example, when a fuel tank pressure decreases to atmospheric pressure.

Emissions control system 251 may include one or more emissions control devices, such as one or more fuel vapor canisters 222 filled with an appropriate adsorbent, the canisters configured to temporarily trap fuel vapors (including vaporized hydrocarbons) during fuel tank refilling operations, diurnal cycles, and "running loss" (that is, fuel vaporized during vehicle operation). In one example, the adsorbent used is activated charcoal.

Canister 222 may house adsorbent buffer 222*a* (or buffer region), and an adsorbent bed 222*b*, each of the adsorbent bed 222*b* and the adsorbent buffer 222*a* comprising the adsorbent. As shown, the volume of adsorbent buffer 222*a* may be smaller than (e.g., a fraction of) the volume of the adsorbent bed 222*b*. The adsorbent in the buffer 222*a* may be same as, or different from, the adsorbent in the bed 222*b* (e.g., both may include charcoal). The fuel tank may be coupled to canister buffer 222*a* via conduit 278 at a load port 233. Buffer 222*a* may be positioned within canister 222 such that during canister loading, fuel tank vapors are first adsorbed within the buffer, and then when the buffer is saturated, further fuel tank vapors are adsorbed in the adsorbent bed. During canister purging, fuel vapors may first be desorbed from the adsorbent bed (e.g., to a threshold amount) before being desorbed from the buffer. In other words, loading and unloading of the buffer is not necessarily linear with the loading and unloading of the canister. As such, the effect of the adsorbent buffer is to dampen any fuel vapor spikes flowing from the fuel tank to the canister, thereby reducing the possibility of any fuel vapor spikes going to the engine. One or more temperature sensors 272 may be coupled to and/or within canister 222. As fuel vapor is adsorbed by the adsorbent in the canister, heat is generated (heat of adsorption). Likewise, as fuel vapor is desorbed by the adsorbent in the canister, heat is consumed. In this way, the adsorption and desorption of fuel vapor by the canister may be monitored and estimated based on temperature changes within the canister.

Fuel system 218 may be operated by controller 212 in a plurality of modes by selective adjustment of the various valves and solenoids. As shown in FIG. 2 emissions control system 251 may include a first two-way valve 292 and a second two-way valve 293, allowing for control of the path of vapor flow, depending on operating conditions. Example configurations are described herein and in further detail with regard to FIGS. 3A-3D. Briefly, first two-way valve 292 and second two-way valve 293 may be configured in a first position or a second position. In some examples, the first and second two-way valves may comprise latchable valves. Herein, the first position refers to the position of valves 292 and 293 indicated in FIG. 2 (an example of the first and second valves in the second position is illustrated in FIG. 3D). When valve 292 is in the first position vent line segment 227*a* may be coupled to vent line segment 227, and when valve 293 is in a first position, purge line segment 228*a* may be coupled to purge line segment 228. As such, canister vent port 232 may couple to atmosphere via canister vent valve 299, and canister purge port 231 may couple to engine intake via canister purge valve 261. In some cases, vent line segment 227*a* may include an air filter 259 disposed therein upstream of a canister 222.

Accordingly, when the first two-way valve 292 and the second two-way valve 293 are configured in first positions, as illustrated in FIG. 2, evaporative emissions system 251 may operate in fuel vapor storage mode wherein controller 212 may command open CVV 299 and command closed CPV 261. As such, fuel tank vapors generated during engine-off conditions, such as refueling operations, diurnal cycles, or when a vehicle is operating in battery-mode, or alternatively during engine on conditions wherein running loss fuel tank vapors are generated, may be directed from the fuel tank through the vapor canister where the vapor may be adsorbed prior to exiting to atmosphere via the open CVV.

Additionally, when the first two-way valve 292 and the second two-way valve 293 are configured in first positions (illustrated in FIG. 2), evaporative emissions system 251 may be operated in a canister purging mode (e.g., after an emission control device light-off temperature has been attained and with the engine running), wherein the controller 212 may open CPV 261 while maintaining CVV 299 open. Herein, the vacuum generated by the intake manifold of the operating engine may be used to draw fresh air through vent line segment 227*a* and vent line segment 227 and through fuel vapor canister 222 to purge the stored fuel vapors into intake manifold 244. In this mode, the purged fuel vapors from the canister are combusted in the engine. The purging may be continued until the stored fuel vapor amount in the canister is below a threshold.

However, there may be circumstances wherein the CPV 261 becomes leaky, described in greater detail below with regard to FIGS. 3C-D. For example, contaminants may become trapped in the CPV, impeding the ability of the CPV to fully close, and/or a sealing surface of the CPV may become deteriorated. As such, fuel vapor storage and control of purging events may become compromised if corrective action is not undertaken. For example, during engine-off conditions wherein the CPV 261 is leaky, if the first two-way valve 292 and the second two-way valve 293 are configured in first positions (illustrated in FIG. 2), and the CVV is open, fuel tank vapors may travel from the fuel tank through adsorbent buffer 222*a*, to engine intake and atmosphere via the leaky CPV 261, thus bypassing the vapor canister adsorbent bed 222*b*. Because vapor canister bed 222*b* may be bypassed as a result of a leaky CPV (see FIG. 3C for more detail), fuel tank vapor may be inadequately adsorbed, thus leading to an increase in evaporative emissions if mitigating action is not undertaken.

To mitigate a leaky CPV, valves 292 and 293 may be configured in a second position with the CVV 299 closed. When valve 292 is in a second position, vent line segment 296 may be coupled to vent line segment 227, wherein vent line segment 296 couples to purge line segment 228 at junction 297, and when valve 293 is in a second position, purge line segment 294 may be coupled to purge line 228*a*, wherein purge line segment 294 couples to vent line segment 227*a* at junction 295. As such, canister vent port 232 may couple to engine intake via CPV 261, and canister purge port 231 may be coupled to atmosphere via CVV 299. Thus, by configuring valves 292 and 293 in the second position and closing the CVV 299 during an engine-off condition, for example a refueling event or a diurnal cycle, fuel tank vapors may be directed from the fuel tank through canister adsorbent buffer 222*a* and canister adsorbent bed 222*b* where the vapors are adsorbed prior to exiting to the atmosphere via the engine intake, the result of the leaky CPV 261 (see FIG. 3D for more detail).

Controller 212 may comprise a portion of a control system 214. Control system 214 is shown receiving information from a plurality of sensors 216 (various examples of which are described herein) and sending control signals to a plurality of actuators 281 (various examples of which are described herein). As one example, sensors 216 may include exhaust gas sensor 237 located upstream of the emission control device, temperature sensor 276, pressure sensor 291, canister temperature sensor 272, manifold pressure sensor 268, and mass air flow sensor 269. Other sensors such as pressure, temperature, air/fuel ratio, and composition sensors may be coupled to various locations in the vehicle system 206. As another example, the actuators may include fuel injector 266, throttle 262, first two-way valve 292, second two-way valve 293, CPV 261, CVV 299, and refueling lock 245. The controller 212 may receive input data from the various sensors, process the input data, and trigger the actuators in response to the processed input data based on instruction or code programmed therein corresponding to one or more routines. An example control routine is described herein with regard to FIG. 4.

Leak detection routines may be intermittently performed by controller 212 on fuel system 218 to confirm that the fuel system is not degraded. As such, leak detection routines may be performed while the engine is off (engine-off leak test) using engine-off natural vacuum (EONV) generated due to a change in temperature and pressure at the fuel tank following engine shutdown and/or with vacuum supplemented from a vacuum pump. Alternatively, leak detection routines may be performed while the engine is running by operating a vacuum pump and/or using engine intake manifold vacuum. As mentioned above, a potential leak path in an emission control system is through a CPV (e.g., 261). In some approaches, pressure readings from a pressure sensor (e.g., 291) in a fuel tank (e.g., 220) may be monitored during engine operation while the CPV is commanded closed in order to determine if a leak is present in the CPV. For example, if a leak is present in the CPV while the CPV is closed and the fuel tank is sealed off from the atmosphere, a vacuum may build in the fuel tank during engine operation which is indicative of a leak in the CPV. As discussed above, a leaky CPV may result in increased evaporative emissions during engine-off conditions due to fuel tank vapors traveling from the fuel tank to engine intake and to atmosphere via the leaky CPV, bypassing the vapor canister adsorbent bed 222*b*. As such, mitigating action may be taken to re-route the fuel tank vapors responsive to a leaky CPV during engine-off conditions, described in detail with regard to FIGS. 3C-D, and the method described in FIG. 4.

Turning to FIGS. 3A-3D, an evaporative emissions system 351 is shown in various conformations. Evaporative emissions system 351 comprises a fuel vapor canister 322 comprised of a fuel vapor adsorbent bed 322*b* and a fuel vapor adsorbent buffer 322*a*, wherein the buffer adsorbent is substantially smaller than the canister adsorbent. Fuel vapor canister adsorbent buffer 322*a* is coupled to a fuel tank (not shown) via load conduit 378. A first two-way valve 392 may be operable to direct air/vapor flow, based on the position of the valve. For example, when valve 392 is in a first position, as indicated for example in FIG. 3A, vent line segment 327*a* may be coupled to vent line segment 327 such that canister vent port 332 may be coupled to atmosphere via CVV 399. Alternatively, when valve 392 is in a second position, as indicated for example in FIG. 3D, vent line segment 396 may be coupled to vent line segment 327 such that canister vent port 332 may couple to engine intake via CPV 361, wherein vent line segment 396 couples to purge line segment 328 at junction 397. Further, a second two-way valve 393 may additionally be operable to direct air/vapor flow, based on the position of the valve. As such, when valve 393 is in a first position, as indicated for example in FIG. 3A, purge line segment 328*a* may be coupled to purge line segment 328 such that a canister purge port 331 may couple to engine intake via CPV 361. Alternatively, when valve 393 is in a second position, as indicated for example in FIG. 3D, purge line segment 394 may be coupled to purge line 328*a* such that the canister purge port 331 may be coupled to atmosphere via CVV 399, wherein purge line segment 394 couples to vent line segment 327*a* at junction 395. Conduit 378 is coupled to fuel vapor canister buffer 322*a* at a load port 333. Canister 322 may be coupled to one or more canister temperature sensors (not shown). Purge line 328 may be coupled to one or more oxygen sensors and/or one or more hydrocarbon sensors (not shown). As will be described in further detail below in regard to FIGS. 3A-3D, and the method described in detail in FIG. 4, by changing the position of the first two-way valve 392 and second two-way valve 393, in conjunction with controlling the open or closed state of the CVV 399, air/vapor flow through the canister may be directed along different paths, depending, for example, on indication of a leaky CPV.

Figure 3A:
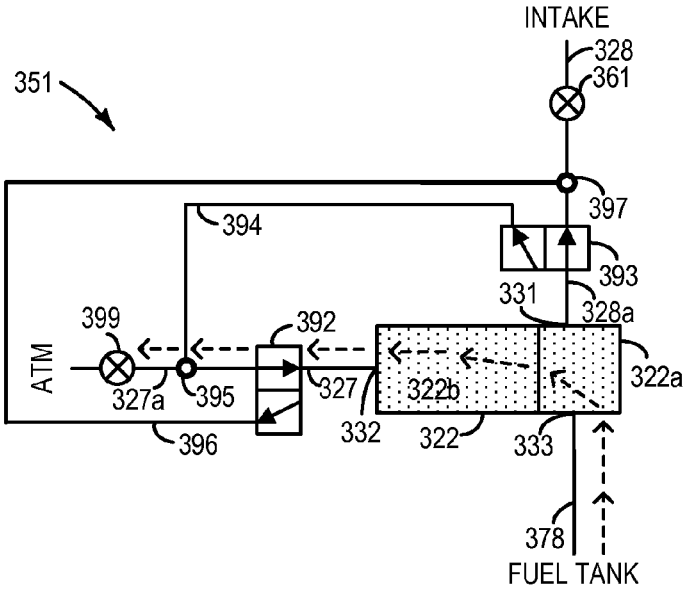
FIGS. 3A-3D schematically show a vehicle evaporative emissions system in various states of operation.

In FIG. 3A, first two-way valve 392 is shown in a first position and second two-way valve 393 is shown in a first position. In this example, CPV 361 may be considered closed, and CVV 399 may be considered open. When valve 392 is in the first position, and the CVV is open, canister vent port 332 is fluidly coupled to atmosphere via vent line segment 327 and vent line segment 327*a*. When the second two-way valve 393 is in the first position, and CPV 361 is closed, vapor flow via canister purge port 331 to engine intake is prevented.

As such, the configuration shown in FIG. 3A allows for fuel vapor storage via the flow path indicated by the dashed arrows, and comprises routing fuel tank vapors across the vapor adsorbent bed to atmosphere when the engine is turned off and the purge valve is not detected as leaking. Accordingly, the configuration illustrated in FIG. 3A may represent a refueling event or a diurnal cycle, wherein excess fuel vapors generated may travel from the fuel tank, through canister adsorbent buffer 322*a* and canister adsorbent bed 322*b* where the vapors are adsorbed, prior to exiting to the atmosphere via open CVV 399. In other examples, the configuration illustrated in FIG. 3A may represent an engine-on event wherein a canister purge event is not indicated. As such, running loss fuel tank vapor generated while the vehicle is in operation with the engine-running, and diurnal and/or refueling fuel tank vapor generation while the engine is off may be stored, and purged to the engine intake to be combusted at a later time.

Figure 3B:
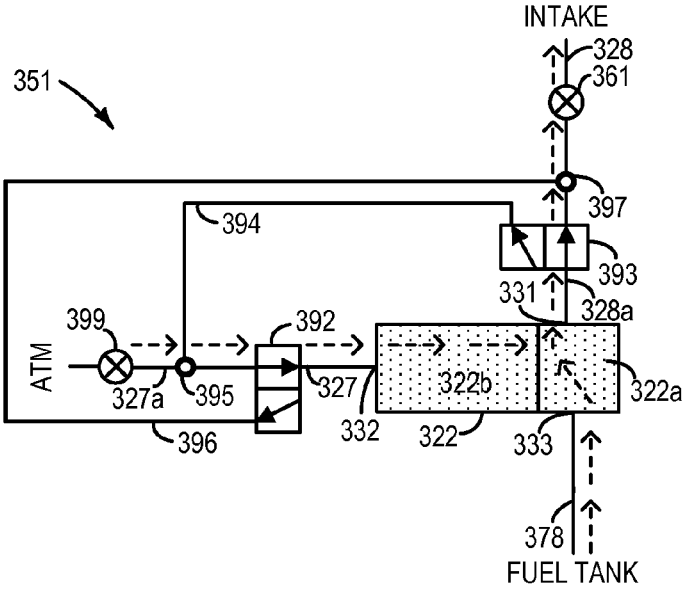

A typical purge operation is illustrated in FIG. 3B. In FIG. 3B, the first two-way valve 392 is shown in a first position and the second two-way valve 393 is shown in a first position. In this example, CVV 399 may be considered open, CPV 361 may be considered open, and the intake manifold may comprise a vacuum sufficient to execute a purging operation. As engine intake vacuum is applied to evaporative emissions system 351, fresh air enters vent line segment 327*a*, passing through valve 392 and vent line 327 into fuel vapor canister 322 via canister vent port 332. Fresh air entering canister 322 will promote desorption of adsorbed fuel vapor within canister adsorbent bed 322*b* and within canister buffer 322*a*. The purge gasses, including desorbed fuel vapor, will then enter purge line segment 328*a*, passing through valve 393 and CPV 361 en route to engine intake. Additionally, fuel tank vapors may travel from the fuel tank to engine intake as a result of the intake manifold vacuum. As such, by opening CPV 361 when the engine is operating under a predetermined set of conditions such that fuel tank vapors are inducted into the engine air intake, and atmospheric air is inducted across the vapor adsorbent to desorb stored fuel vapors which are then inducted into the engine air intake, the configuration shown in FIG. 3B enables fuel vapor canister purging via the flow path indicated by the dashed arrows.

However, there may be circumstances wherein the CPV becomes leaky. For example, during the course of vehicle operation, contaminants may accumulate and become lodged within the evaporative emission control system (Evap system). Contaminants may include plastic, nylon, polyester, silk, cardboard fibers, olefin, dirt, carbon pellets or dust, other fibers or small particles, or a combination thereof. In particular, contaminants may become trapped in the CPV, impeding the ability of the CPV to fully close. In addition, a sealing surface of the CPV may become deteriorated. As such, if the CPV becomes leaky, fuel vapor storage and control of purging events may become compromised if corrective action is not undertaken.

Figure 3C:
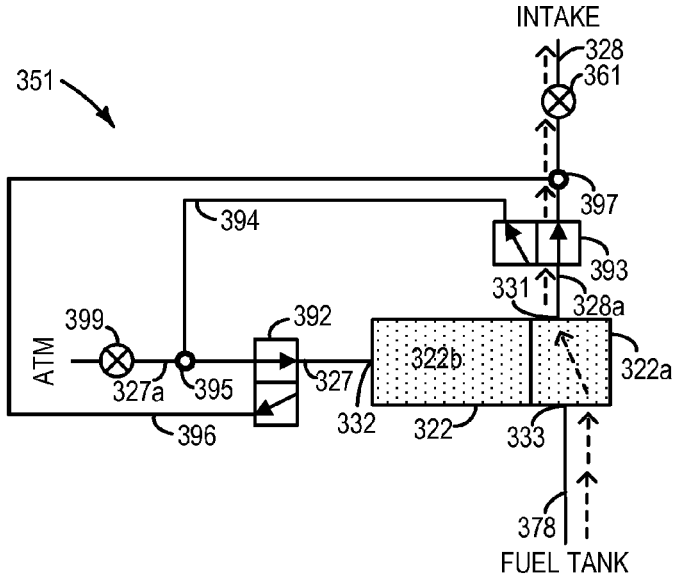
Figure 3D:
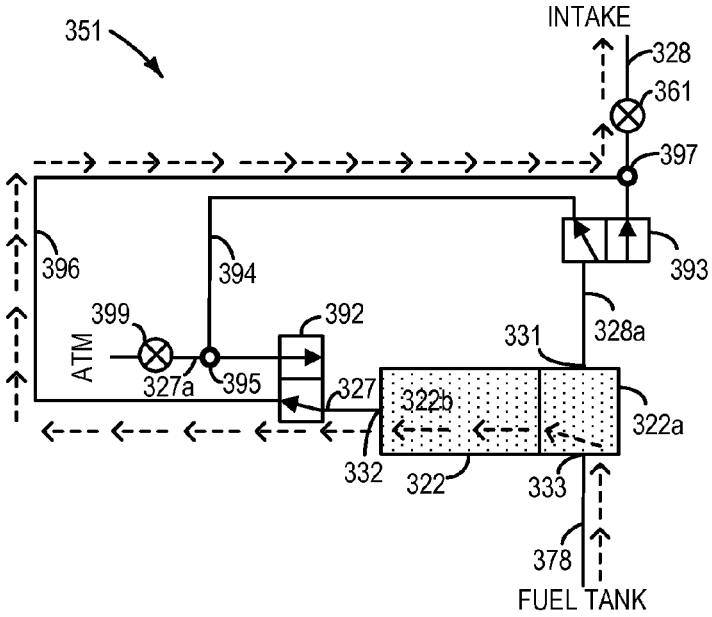

Now turning to FIG. 3C, an example illustration is shown depicting a vapor flow path in a case wherein a leak in the CPV is indicated. In FIG. 3C the first two-way valve 392 is shown in a first position and the second two-way valve 393 is shown in a first position. In this example, CVV 399 may be considered open, and CPV 361 may be considered leaky. In this example, during an engine-off condition representing, for example a refueling event or a diurnal cycle, rather than travel along the path indicated in FIG. 3A, fuel tank vapors may instead travel via the flow path of least resistance indicated by the dashed arrows in FIG. 3C. As such, fuel vapors may travel from the fuel tank through canister buffer 322*a*, to engine intake via the leaky CPV 361, thus bypassing the vapor canister adsorbent bed 322*b*. Because vapor canister adsorbent bed 322*b* may be bypassed as a result of a leaky CPV, fuel tank vapor may be inadequately adsorbed, thus leading to an increase in evaporative emissions if mitigating action is not undertaken. In another example, including an engine-on condition, a leaky CPV 361 may result in a purge condition (see FIG. 3B) at any instance during vehicle operation wherein intake manifold vacuum is sufficient to draw air through the canister via an open CVV 399 and sufficient to pull vapors from the fuel tank. Under such conditions, prior art methodology may be used to compensate for the induction of fuel vapors into the intake manifold via the leaky CPV 361, described in more detail below with regard to FIG. 4. Briefly, a compensation factor may be generated comprising a learned concentration of desorbed vapors from the fuel tank in response to an exhaust air/fuel ratio indication, which may be used to correct for induction of fuel vapors.

Now turning to FIG. 3D, responsive to an indication of a leaky CPV, mitigating action may be undertaken to prevent bleed-through evaporative emissions. In FIG. 3D, the first two-way valve 392 is shown in a second position and the second two-way valve 393 is shown in a second position. In this configuration, vent line segment 396 may be coupled to vent line segment 327 such that the canister vent port 332 may couple to engine intake via CPV 361, wherein vapor line segment 396 couples to purge line segment 328 at junction 397. Further, purge line segment 394 may be coupled to purge line segment 328*a* such that the canister purge port 331 may be coupled to atmosphere via CVV 399, wherein purge line segment 394 couples to vent line segment 327*a* at junction 395. In this example, CVV 399 may be considered closed, and CPV 361 may be considered leaky. By changing the position of the first (392) and second (393) two way valves, and closing CVV 399 to isolate the canister from atmosphere, the configuration shown in FIG. 3D allows for fuel vapor storage via the flow path indicated by the dashed arrows. As such, during an engine-off condition, for example a refueling event or a diurnal cycle, rather than traveling along the path indicated by the dashed arrows in FIG. 3C wherein vapor canister adsorbent bed 322*b* may be bypassed leading to increased emissions, by changing the position of the first (392) and second (393) two way valves, and closing CVV 399, fuel tank vapors may be re-routed from the fuel tank through canister buffer 322*a* and canister bed 322 where the vapors are adsorbed prior to exiting to the atmosphere via the engine intake, the result of the leaky CPV 361. In other words, when the purge valve is detected as leaking and the engine is not operating, by changing the routing fuel tank vapors may be first routed through the vapor adsorbent (e.g., 322) for adsorption and then to the purge valve.

Turning to FIG. 4, a flow chart for an example method 400 for controlling a vehicle engine to regulate the flow of fuel vapor in response to an indication of a leaky CPV is shown. More specifically, method 400 may be used to, responsive to an intact CPV (non-leaking), store fuel tank vapors by coupling a canister purge port to engine intake and a canister vent port to atmosphere, and directing fuel tank vapors to the vapor canister via opening a CVV and closing the CPV. Alternatively, responsive to an indication of a leaky CPV, method 400 may be used to store fuel tank vapors by coupling the canister purge port to atmosphere and the canister vent port to engine intake, and directing fuel tank vapors to the vapor canister via closing the CVV. As such, responsive to a leaky CPV, fuel tank vapors are adsorbed in the fuel vapor canister rather than being released to the atmosphere, as described in more detail in relation to the method 400 described below and with regard to FIGS. 3A-3D described above. Method 400 will be described with reference to the systems described herein and shown in FIGS. 1-3D, though it should be understood that similar methods may be applied to other systems without departing from the scope of this disclosure. Method 400 may be carried out by a controller, such as controller 212 in FIG. 2, and may be stored at the controller as executable instructions in non-transitory memory. Instructions for carrying out method 400 and the rest of the methods included herein may be executed by a controller based on instructions stored on a memory of the controller and in conjunction with signals received from sensors of the engine system, such as the sensors described above with reference to FIGS. 1 and 2. The controller may employ engine actuators of the engine system to adjust engine operation, according to the methods described below.

Method 400 begins at 402 and includes evaluating current operating conditions. Operating conditions may be estimated, measured, and/or inferred, and may include one or more vehicle conditions, such as vehicle speed, vehicle location, etc., various engine conditions, such as engine status, engine load, engine speed, A/F ratio, etc., various fuel system conditions, such as fuel level, fuel type, fuel temperature, etc., various evaporative emissions system conditions, such as fuel vapor canister load, fuel tank pressure, etc., as well as various ambient conditions, such as ambient temperature, humidity, barometric pressure, etc. At 404, method 400 includes indicating whether a leak in the CPV has been detected based on diagnostics performed on the evaporative emission control system to detect leaks in the system. In one example a diagnostic test may include closing the CPV, isolating the vapor canister from atmosphere (e.g., closing the CVV), and indicating a leak in the CPV when vapor pressure in the fuel tank falls below a predetermined pressure (below a threshold). If at 404 a CPV leak is not indicated, method 400 proceeds to 406. At 406, method 400 includes coupling purge port (e.g., 331) to engine intake and canister vent port (e.g., 332) to atmosphere. In other words, first two-way valve 392 and second two-way valve 393 may be commanded or maintained in a first position as described in detail in regard to FIG. 3 above.

Following coupling purge port (e.g., 331) to engine intake and canister vent port (e.g., 332) to atmosphere via positioning the first (392) and second (393) two-way valves in a first position, method 400 proceeds to 408 where it is indicated whether the engine is on. An engine-on condition may include a condition wherein the vehicle is operating solely by engine combustion, or may additionally include a condition wherein the vehicle may be operating via a combination of engine combustion and battery power (such as hybrid system described in FIG. 1). If at 408 it is determined that the engine is not on, method 400 proceeds to 410. At 410 method 400 includes commanding closed or maintaining closed the CPV, and commanding open or maintaining open the CVV 399. In this way, during an engine-off condition including for example a refueling event or during a diurnal cycle, fuel tank vapors may be routed from the fuel tank into a vapor adsorbent by traveling through canister adsorbent buffer (e.g., 322*a*), and canister adsorbent bed (e.g., 322*b*) where the vapor may be adsorbed, prior to exiting the evaporative emissions system to atmosphere via the open CVV (e.g., 399), as described in detail in FIG. 3A. Method 400 may then proceed to 412, wherein engine operating parameters are updated. At 412, updating engine operating parameters may include updating a canister loading state to reflect a refueling event, for example. Method 400 may then end.

Returning to 408, if it is determined that the vehicle is operating in an engine-on condition, method 400 proceeds to 414 where it is determined whether purge conditions are met. Purge conditions may include an engine-on condition, a canister load above a threshold, an intake manifold vacuum above a threshold, an estimate or measurement of temperature of an emission control device such as a catalyst being above a predetermined temperature associated with catalytic operation commonly referred to as light-off temperature, a non-steady state engine condition, and other operating conditions that would not be adversely affected by a canister purge operation. If at 414 purge conditions are not met, method 400 proceeds to 416 and includes commanding closed or maintaining closed the CPV, and commanding open or maintaining open the CVV. As such, during an engine-on condition wherein a canister purge operation is not indicated, running loss fuel tank vapors may be directed from the fuel tank through the canister buffer and canister where the vapor may be adsorbed prior to exiting the evaporative emissions system to fresh air via the open CVV, as described in detail in FIG. 3A. Method 400 may then proceed to 412, wherein engine operating parameters are updated. At 412, updating engine operating parameters may include updating a canister purge schedule to indicate that a canister purge operation did not occur and that running loss vapors are being stored in the vapor canister. Method 400 may then end.

Returning to 414, if purge conditions are met, method 400 proceeds to 418. At 418, method 400 includes commanding open the CPV and commanding open or maintaining open the CVV. In some examples, commanding open the CPV may include gradually opening the CPV. As the purge port (e.g. 331) is coupled to engine intake and the canister vent port (e.g., 332) is coupled to atmosphere, opening the CPV while concurrently opening or maintaining open the CVV results in engine intake vacuum drawing fresh air into the canister to promote desorption of adsorbed fuel vapor within canister 322, the purge gasses routed to engine intake to be combusted, as described in further detail in FIG. 3B. Briefly, with the vapor adsorbent vented to atmosphere, by opening the CPV, desorbed vapors from the vapor adsorbent and vapors from the fuel tank may be routed through the purge valve and into the engine for combustion. Proceeding to 420, method 400 includes purging the canister. At 420, purging the canister may include indicating an air/fuel ratio via, for example, a proportional plus integral feedback controller coupled to a two-state exhaust gas oxygen sensor, and responsive to the air/fuel indication and a measurement of inducted air flow, generating a base fuel command. To compensate for purge vapors, a reference air/fuel ratio, related to engine operation without purging, may be subtracted from the air/fuel ratio indication and the resulting error signal (compensation factor) generated. As such, the compensation factor may represent a learned value directly related to fuel vapor concentration, and may be subtracted from the base fuel command to correct for the induction of fuel vapors. The duration of the purging operation may be based on the learned value (or compensation factor) of the vapors such that when it is indicated there are no appreciable hydrocarbons in the vapors (the compensation is essentially zero), the purge may be ended. Accordingly, following purging, method 400 proceeds to 422 where the CPV is commanded closed. Following the closing of the CPV, method 400 thus proceeds to 412 wherein engine operating parameters are updated. For example, at 412, updating engine operating parameters may include updating a canister purge schedule to indicate the completed canister purge event, updating the canister loading state to reflect the recent canister purge, etc. Method 400 may then end.

Returning to 404, if a CPV leak is detected, method 400 proceeds to 424 and includes opening the CVV to relieve the vacuum build in the fuel tank resulting from the leaky CPV. Following relieving the fuel tank vacuum at 424, the method proceeds to 426. At 426, method 400 includes indicating whether the engine is on. As described above, an engine-on condition may include a condition wherein the vehicle is operating solely by engine combustion, or may additionally include a condition wherein the vehicle may be operating via a combination of engine combustion and battery power (such as hybrid system in FIG. 1). If at 426 it is determined that the engine is not on, method 400 proceeds to 428. At 428 method 400 includes configuring the first two-way valve 392 in a second position and the second two-way valve 393 in a second position thereby coupling canister vent port 332 to engine intake and coupling canister purge port 331 to atmosphere as described above in regard to FIG. 3. Method 428 then proceeds to 430, wherein the method includes commanding closed or maintaining closed the CVV 399. By closing CVV 399 at 430 following coupling canister vent port 332 to engine intake and coupling canister purge port 331 to atmosphere at 426, the vapor canister may thus be isolated from atmosphere such that vapors from the fuel tank are re-routed through the vapor canister and to engine intake via the leaky CPV 361 (see FIG. 3D) for the duration of the engine-off event. In some examples, closing CVV 399 at 430 may additionally include commanding open the leaky CPV 361. As such, commanding open the leaky CPV at 428 may serve to further encourage the routing of fuel tank vapor through the vapor canister and to engine intake via the CPV. Method 400 may then proceed to 432 wherein engine operating parameters are updated. Updating engine operating parameters at 432 may include updating a canister loading state to reflect a new canister load as a result of vapors stored during the duration of the engine-off event, for example. Method 400 may then end.

Returning to 426, if it is determined that the vehicle is operating in an engine-on condition, method 400 proceeds to 434. At 434, method 400 includes coupling purge port (e.g., 331) to engine intake and canister vent port (e.g., 332) to atmosphere. In other words, first two-way valve 392 and second two-way valve 393 may be commanded or maintained in a first position as described in detail in regard to FIG. 3 above. By coupling purge port (e.g., 331) to engine intake and canister vent port (e.g., 332) to atmosphere, during engine on conditions wherein sufficient manifold vacuum is not present to draw air/vapor flow through the leaky CPV, running loss fuel tank vapors may travel from the fuel tank through the vapor canister where they may be adsorbed before exiting to atmosphere via the open CVV (see FIG. 3A for example), and any fuel tank vapors that make their way into the engine intake via the leaky CPV will be combusted. Alternatively, during engine-on conditions wherein manifold vacuum is sufficient to draw air/vapor flow through the leaky CPV, fresh air may be drawn through the vapor canister via the open CVV, thus desorbing fuel tank vapors stored therein, which may then travel to engine intake via the leaky CPV to be combusted (for example via flow path indicated in FIG. 3B). As such, depending on the size of the CPV leak and the level of intake manifold vacuum, the extent to which the canister may be purged may vary under conditions wherein an active purge (e.g., commanded open CPV) is not indicated. Additionally, manifold vacuum sufficient to draw air/vapor flow through the leaky CPV may further draw fuel tank vapors from the fuel tank, through the canister buffer, to engine intake via the leaky CPV where they may be combusted in the engine. Thus, under conditions wherein the CPV is leaky and an active purge is not indicated, the engine may compensate for increases in fuel vapor delivered to the intake manifold resulting from the leaky CPV, as described further below.

Proceeding to 436, method 400 includes determining whether purge conditions are met. As described above, purge conditions may include an engine-on condition, catalyst temperature above a predetermined value, a canister load above a threshold, an intake manifold vacuum above a threshold, a non-steady state engine condition, and other operating conditions that would not be adversely affected by a canister purge operation. If at 436 purge conditions are not met, method 400 proceeds to 438 and includes maintaining desired air-fuel ratio during engine operation. As discussed above (and with regard to FIG. 3C), responsive to a leaky CPV, during engine-on conditions wherein intake manifold vacuum is sufficient to draw air through the canister via an open CVV and sufficient to pull vapors from the fuel tank, the induction of fuel vapors may result in a non-desired air/fuel ratio if not compensated for. As such, at 438, method 400 may include compensating for the induction of vapors into the intake via the leaky CPV by a learned compensation factor as described above with regard to step 420 of method 400. Because fuel vapors inducted to the intake manifold under conditions of intake manifold vacuum may be compensated for as described, first two-way valve 392 and second two-way valve 393 may be maintained in a first position during engine-on conditions wherein purge conditions are not met.

Proceeding to 446, method 400 includes updating engine operating parameters. Updating engine operating parameters at 446 may include indicating a canister loading state as a result of an indication that fuel vapors were inducted into the intake manifold at 438, and may thus include updating a canister purge schedule. Method 400 may then end.

Returning to 436, if purge conditions are met, method 400 proceeds 440, and includes commanding open the CPV and maintaining open the CVV. In some examples commanding open the CPV may include gradually opening the CPV. Following opening the CPV at 440, the canister may be purged at 442. As described above in regard to FIG. 3B, opening the CPV while concurrently opening or maintaining open the CVV while the fuel system is configured such that the purge port (e.g., 331) is coupled to engine intake and the canister vent port (e.g., 332) is coupled to atmosphere purges the vapor canister to engine intake by drawing fresh air into the canister to promote desorption of adsorbed fuel. Further, method 442 may include compensating for purge vapors via a learned compensation factor as described above with regard to step 420 of method 400 such that a desired air/fuel ratio is maintained. The duration of the purging operation may be based on the learned value (compensation factor) of the vapors such that when it is indicated there are no appreciable hydrocarbons in the vapors (the compensation is essentially zero), the purge may be ended. Accordingly, following purging, method 400 proceeds to 444 where the CPV is commanded closed. Following the closing of the CPV, method 400 thus proceeds to 446 wherein engine operating parameters are updated. For example, at 446, updating engine operating parameters may include updating a canister purge schedule to indicate the completed canister purge event, updating the canister loading state to reflect the recent canister purge, etc. Method 400 may then end.

FIG. 5 shows an example timeline 500 for detecting a leaky CPV and performing mitigating action to prevent resulting evaporative emissions according to the methods described herein and with reference to FIG. 4, and as applied to the systems described herein and with reference to FIGS. 1-3D. Timeline 500 includes plot 502, indicating whether a CPV leak has been detected, over time. Timeline 500 further includes plot 504, indicating whether the vehicle is operating in an engine-on mode, over time. Timeline 500 further includes plot 506 indicating whether a CPV is open or closed, and plot 508, indicating whether a CVV is open or closed, over time. Timeline 500 further includes indicating a fuel tank pressure, via FTPT (e.g., 291), over time. Line 512 represents a threshold vacuum level, wherein a fuel tank vacuum build to a threshold level may indicate a leaky CPV, under conditions where the fuel tank is sealed from atmosphere. Timeline 500 further includes plot 514, indicating whether a first two-way valve (e.g., 392), is in a first position or a second position, over time. More specifically, when the first two-way valve 392 is in a first position, as indicated for example in FIG. 3A, canister vent port (e.g., 332) may couple to atmosphere via canister vent valve (e.g., 399). Alternatively, when the first two-way valve 392 is in a second position, as indicated for example in FIG. 3D, canister vent port (e.g., 332) may couple to engine intake via canister purge valve (e.g., 361). Timeline 500 further includes plot 516, indicating whether a second two-way valve (e.g., 393), is in a first position or a second position, over time. More specifically, when the second two-way valve 393 is in a first position, canister purge port (e.g., 331) may couple to engine intake via canister purge valve (e.g., 361), as indicated for example in FIG. 3A. Alternatively, when the second two-way valve 393 is in a second position, as indicated for example in FIG. 3D, the canister purge port (e.g., 331) may be coupled to atmosphere via canister vent valve (e.g., 399).

At time to the vehicle is operating with the engine on, which may include a condition wherein the vehicle is operating solely by engine combustion, or may additionally include a condition wherein the vehicle may be operating via a combination of engine combustion and battery power. First two-way valve (392) is configured in the first position and second two-way valve (393) is configured in the first position such that canister vent port (e.g., 332) may couple to atmosphere via CVV (e.g., 399) and purge port (e.g., 331) may couple to engine intake via canister purge valve (e.g., 361). The CVV (399), indicated by plot 508 is open, and the CPV (361), indicated by plot 506, is closed. Accordingly, fuel tank pressure, indicated by plot 510, is at atmospheric pressure. No CPV leak has been detected, indicated by plot 502.

At time $t_1$ a diagnostic test for a leaky CPV is initiated by commanding closed the CVV to seal the evaporative emissions system, while maintaining the CPV closed. As the engine is on, if the CPV is leaky then manifold vacuum may draw air/vapor from the fuel tank, resulting in a fuel tank vacuum build. Between time $t_1$ and $t_2$, a fuel tank vacuum build is indicated, as measured by FTPT (e.g., 291). At time $t_2$, fuel tank vacuum build reaches a threshold, indicated by line 512. In other examples, a threshold fuel tank vacuum build may be based on a vacuum-build rate. As the fuel tank vacuum build has reached a threshold value at time $t_2$ the presence of a CPV leak determined, indicated by plot 502. Further, at time $t_2$ the CVV may be commanded open, such that the fuel tank vacuum may be relieved. As such, between time $t_2$ and $t_3$, fuel tank pressure returns to atmospheric pressure.

At time $t_3$ the engine is turned off. An engine-off condition may include a vehicle operating solely in battery-mode, or alternatively may include a key-off condition. Because a CPV leak has been detected, and the first two-way valve (392) is in the first position and the second two-way valve (393) is in the first position, if mitigating action is not taken, fuel tank vapors generated, for example during a refueling event or during a diurnal cycle, may travel via a path of least resistance from the fuel tank, through the canister adsorbent buffer and to engine intake via the leaky CPV, wherein the vapors may be released to atmosphere (see FIG. 3C). As such, upon indication of an engine-off event at time $t_3$, first two-way valve (292) may be commanded to the second position, and second two-way valve (293) may be commanded to the second position such that canister vent port (e.g., 332) may couple to engine intake via canister purge valve (e.g., 361), and the canister purge port (e.g., 331) may be coupled to atmosphere via canister vent valve (e.g., 399). Configured as such, additionally closing CVV at time $t_3$ serves to seal the canister, thus fuel tank vapors may be directed from the fuel tank through the canister adsorbent bed where the vapors are adsorbed prior to exiting to the atmosphere through the engine intake via the leaky CPV. Thus, between time $t_3$ and $t_4$, while the engine is off, rather than fuel tank vapors being released to the atmosphere, the vapors may be first adsorbed in the vapor canister prior to exiting to the atmosphere via the leaky CPV.

In this way, by adjusting the position of a first two-way valve positioned between a canister vent port and a canister vent valve and the position of a second two-way valve positioned between a canister purge port and said purge valve, in conjunction with adjusting a CVV and a CPV, fuel tank vapors may be routed along various pathways of an evaporative emissions system, based on engine operating conditions. In one example, responsive to an indication of a canister purge valve leak, the position of the first-two way valve and the second two-way valve may be changed, in conjunction with closing the CVV such that fuel tank vapors are directed through the fuel vapor canister en route to the engine intake via the leaky CPV. By configuring the evaporative emissions system as such, during engine off conditions, rather than fuel tank vapors traveling from the fuel tank to engine intake via a route wherein the vapor canister may be bypassed, fuel tank vapors may instead be directed through the vapor canister wherein they may be adsorbed efficiently. As such, responsive to an indication of a leaky CPV, evaporative emissions may be prevented during engine off conditions whereas in the absence of mitigating action excessive evaporative emissions may result.

The technical effect of incorporating a first two-way valve positioned between a canister vent port and a canister vent valve and a second two-way valve positioned between a canister purge port and canister purge valve, is to enable a re-routing of fuel tank vapor responsive to an indication of a CPV leak. In the absence of an ability to re-route fuel tank vapors, no other mitigating action may efficiently address the increase in fuel tank vapors that may be released to atmosphere as a result of a leaky CPV during engine-off conditions. As the time duration between an indication of a leaky CPV and when the vehicle is serviced may vary, preventing evaporative emissions upon indication of a leaky CPV is imperative. By re-routing fuel tank vapors during engine-off conditions using the methods and systems described herein, evaporative emissions may be reliably prevented without compromising functionality of the evaporative emissions system.

The systems described herein and with reference to FIGS. 1-3D, along with the methods described herein and with reference to FIG. 4 may enable one or more systems and one or more methods. In one example, a method comprises when an engine is operating, routing vapors from a fuel tank through a purge valve, and routing desorbed vapors from a vapor adsorbent through said purge valve, into said engine for combustion; and when said purge valve is detected as leaking and said engine is not operating, changing said routing so that said fuel tank vapors are first routed through said vapor adsorbent for adsorption and then to said purge valve. In a first example of the method, the method includes wherein said vapors from said fuel tank are routed through a buffer adsorbent before said routing through said purge valve, and said desorbed vapors from said vapor adsorbent are routed through said buffer adsorbent before said routing through said purge valve, said buffer adsorbent is substantially smaller than said vapor adsorbent. A second example of the method optionally includes the first example and further comprises closing said purge valve and routing said fuel tank vapors across said vapor adsorbent to atmosphere when said engine is turned off and said purge valve is not detected as leaking. A third example of the method optionally includes one or more or each of the first and second examples and further includes wherein said vapor adsorbent is housed in a canister and further comprising: venting said canister to atmosphere when said purge valve is not detected as leaking; and isolating said canister from atmosphere when said purge valve is detected as leaking and said engine is turned off. A fourth example of the method optionally includes any one or more or each of the first through third examples and further comprises opening said purge valve when said engine is operating under a predetermined set of conditions so that said fuel tank vapors are inducted into said engine air intake, and atmospheric air is inducted across said vapor adsorbent to desorb stored fuel vapors which are then inducted into said engine air intake. A fifth example of the method optionally includes any one or more or each of the first through fourth examples and further includes wherein said vapor adsorbent is housed in a canister and further comprising performing a diagnostic test on said purge valve while said engine is running, said diagnostic test comprising: closing said purge valve; isolating said canister from atmosphere; and indicating a leak in said purge valve when vapor pressure in said fuel tank falls below a predetermined pressure.

Another example of a method comprises when an engine is off, routing fuel vapors from a fuel tank into a vapor adsorbent and venting said vapor adsorbent to atmosphere; when said engine is operating, venting said vapor adsorbent to atmosphere, and routing vapors from said fuel tank through a purge valve, and desorbed vapors from said vapor adsorbent through said purge valve, into said engine for combustion; and when said purge valve is detected as leaking and said engine is turned off, closing said purge valve, isolating said canister from atmosphere, and re-routing said vapors in said tank first through said vapor adsorbent and then to said purge valve. In a first example of the method, the method further comprises supplying air to said engine and supplying fuel from said fuel tank to said engine, and combusting in a plurality of combustion chambers within said engine, said air, said fuel, said vapors from said fuel tank and said desorbed vapors in said engine. A second example of the method optionally includes the first example and further comprises adjusting said fuel from said fuel tank in response to an indication of engine exhaust air/fuel ratio to maintain an overall stoichiometric mixture of said air, said fuel from said fuel tank, said vapors from said fuel tank, and said desorbed vapors. A third example of the method optionally includes any one or more of or each of the first and second examples and further includes wherein said vapor adsorbent is housed in a canister and said purge valve is coupled to an intake manifold of said engine which in turn is coupled to each of said combustion chambers. A fourth example of the method optionally includes any one or more or each of the first through third examples and further comprises performing a diagnostic test on said purge valve while said engine is running, said diagnostic test comprising: closing said purge valve; isolating said canister from atmosphere; and indicating a leak in said purge valve if vapor pressure in said fuel tank falls below a predetermined pressure during said diagnostic test. A fifth example of the method optionally includes any one or more or each of the first through fourth examples and further includes wherein said purge valve is opened when said engine is operating and an estimate or measurement of temperature of a catalyst coupled to exhaust of said engine is above a predetermined temperature. A sixth example of the method optionally includes any one or more or each of the first through fifth examples and further includes wherein said purge valve is gradually opened. A seventh example of the method optionally includes any one or more or each of the first through sixth examples and further comprises learning concentration of said desorbed vapors and said vapors from said fuel tank in response to said exhaust air/fuel ratio indication.

An example of an evaporative emissions system for a vehicle comprises a fuel vapor canister comprising: an adsorbent bed and an adsorbent buffer, said adsorbent bed coupled to a canister vent port and said adsorbent buffer coupled to a canister load port and a canister purge port; a fuel tank fluidly connected to said vapor canister adsorbent buffer at said canister load port; a first two-way valve positioned in a vapor line between said canister vent port of said vapor canister and a canister vent valve (CVV), a second two-way valve positioned in a vapor line between said canister purge port of said vapor canister and a canister purge valve (CPV), a controller, holding executable instructions stored in non-transitory memory, that when executed, cause said controller to: responsive to a first condition, direct vapor from said fuel tank through said canister adsorbent buffer and said canister adsorbent bed via opening said canister vent valve (CVV) and controlling said first two-way valve and said second two-way valve; and responsive to a second condition, direct vapor from said fuel tank through said canister adsorbent buffer and said canister adsorbent bed via closing said CVV and controlling said first two-way valve and said second two-way valve. In a first example, the system further includes wherein said controller further holds executable instructions stored in non-transitory memory, that when executed, cause said controller to: responsive to said first condition, command or maintain said first two-way valve in a first position such that said canister vent port of said vapor canister bed is fluidly coupled to atmosphere via said CVV, command or maintain said second two-way valve in a first position such that said canister purge port of said vapor canister buffer is fluidly coupled to engine intake via said CPV, responsive to said second condition, command or maintain said first two-way valve in a second position such that said canister vent port of said vapor canister is fluidly coupled to said engine intake via said CPV, via a junction between said CPV and said second two-way valve, and command or maintain said second two-way valve in a second position such that said canister purge port is fluidly coupled to atmosphere via said CVV, via a junction between said first two-way valve and said CVV. A second example of the system optionally includes the first example and further includes wherein said first condition comprises a non-leaking CPV commanded or maintained in a closed state, and wherein said second condition comprises a leaky CPV. A third example of the system optionally includes any one or more or each of the first and second examples and further includes wherein said first condition further comprises, responsive to a loading state of said vapor canister being above a threshold, opening said CPV and maintaining said CVV open such that air flow is directed from said canister adsorbent bed to said canister adsorbent buffer in order to purge desorbed vapors in said vapor canister to an intake manifold of an engine. A fourth example of the system optionally includes any one or more or each of the first through third examples and further includes wherein said second condition comprises an engine-off condition. A fifth example of the system optionally includes any one or more or each of the first through fourth examples and further includes wherein said first and second two-way valves are latchable.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method comprising:

when an engine is operating, routing vapors from a fuel tank through a purge valve, and routing desorbed vapors from a vapor adsorbent through said purge valve, into said engine for combustion; and when said purge valve is detected as leaking and said engine is not operating, changing said routing so that said fuel tank vapors are first routed through said vapor adsorbent for adsorption and then to said purge valve.

2. The method recited in claim 1, wherein said vapors from said fuel tank are routed through a buffer adsorbent before said routing through said purge valve, and said desorbed vapors from said vapor adsorbent are routed through said buffer adsorbent before said routing through said purge valve, said buffer adsorbent is substantially smaller than said vapor adsorbent.

3. The method recited in claim 1, further comprising closing said purge valve and routing said fuel tank vapors across said vapor adsorbent to atmosphere when said engine is turned off and said purge valve is not detected as leaking.

4. The method recited in claim 1, wherein said vapor adsorbent is housed in a canister and further comprising: venting said canister to atmosphere when said purge valve is not detected as leaking; and isolating said canister from atmosphere when said purge valve is detected as leaking and said engine is turned off.

5. The method recited in claim 4, further comprising: opening said purge valve when said engine is operating under a predetermined set of conditions so that said fuel tank vapors are inducted into said engine air intake, and atmospheric air is inducted across said vapor adsorbent to desorb stored fuel vapors which are then inducted into said engine air intake.

6. The method recited in claim 1, wherein said vapor adsorbent is housed in a canister and further comprising performing a diagnostic test on said purge valve while said engine is running, said diagnostic test comprising: closing said purge valve; isolating said canister from atmosphere; and indicating a leak in said purge valve when vapor pressure in said fuel tank falls below a predetermined pressure.

7. A method comprising:

when an engine is off, routing fuel vapors from a fuel tank into a vapor adsorbent and venting said vapor adsorbent to atmosphere;

when said engine is operating, venting said vapor adsorbent to atmosphere, and routing vapors from said fuel tank through a purge valve, and desorbed vapors from said vapor adsorbent through said purge valve, into said engine for combustion; and when said purge valve is detected as leaking and said engine is turned off, closing said purge valve, isolating said canister from atmosphere, and re-routing said vapors in said tank first through said vapor adsorbent and then to said purge valve.

8. The method recited in claim 7, further comprising supplying air to said engine and supplying fuel from said fuel tank to said engine, and combusting in a plurality of combustion chambers within said engine, said air, said fuel, said vapors from said fuel tank and said desorbed vapors in said engine.

9. The method recited in claim 8, further comprising adjusting said fuel from said fuel tank in response to an indication of engine exhaust air/fuel ratio to maintain an overall stoichiometric mixture of said air, said fuel from said fuel tank, said vapors from said fuel tank, and said desorbed vapors.

10. The method recited in claim 9, wherein said vapor adsorbent is housed in a canister and said purge valve is coupled to an intake manifold of said engine which in turn is coupled to each of said combustion chambers.

11. The method recited in claim 10, further comprising performing a diagnostic test on said purge valve while said engine is running, said diagnostic test comprising: closing said purge valve; isolating said canister from atmosphere; and indicating a leak in said purge valve if vapor pressure in said fuel tank falls below a predetermined pressure during said diagnostic test.

12. The method recited in claim 7, wherein said purge valve is opened when said engine is operating and an estimate or measurement of temperature of a catalyst coupled to exhaust of said engine is above a predetermined temperature.

13. The method recited in claim 12, wherein said purge valve is gradually opened.

14. The method recited in claim 9, further comprising learning concentration of said desorbed vapors and said vapors from said fuel tank in response to said exhaust air/fuel ratio indication.

15. An evaporative emissions system for a vehicle, comprising:

a fuel vapor canister comprising: an adsorbent bed and an adsorbent buffer, said adsorbent bed coupled to a canister vent port and said adsorbent buffer coupled to a canister load port and a canister purge port;

a fuel tank fluidly connected to said vapor canister adsorbent buffer at said canister load port;

a first two-way valve positioned in a vapor line between said canister vent port of said vapor canister and a canister vent valve (CVV), a second two-way valve positioned in a vapor line between said canister purge port of said vapor canister and a canister purge valve (CPV), a controller, holding executable instructions stored in non-transitory memory, that when executed, cause said controller to:

responsive to a first condition, direct vapor from said fuel tank through said canister adsorbent buffer and said canister adsorbent bed via opening said canister vent valve (CVV) and controlling said first two-way valve and said second two-way valve; and responsive to a second condition, direct vapor from said fuel tank through said canister adsorbent buffer and said canister adsorbent bed via closing said CVV and controlling said first two-way valve and said second two-way valve.

16. The evaporative emissions system of claim 15, wherein said controller further holds executable instructions stored in non-transitory memory, that when executed, cause said controller to:

responsive to said first condition, command or maintain said first two-way valve in a first position such that said canister vent port of said vapor canister bed is fluidly coupled to atmosphere via said CVV, command or maintain said second two-way valve in a first position such that said canister purge port of said vapor canister buffer is fluidly coupled to engine intake via said CPV, responsive to said second condition, command or maintain said first two-way valve in a second position such that said canister vent port of said vapor canister is fluidly coupled to said engine intake via said CPV, via a junction between said CPV and said second two-way valve, and command or maintain said second two-way valve in a second position such that said canister purge port is fluidly coupled to atmosphere via said CVV, via a junction between said first two-way valve and said CVV.

17. The evaporative emissions system of claim 16, wherein said first condition comprises a non-leaking CPV commanded or maintained in a closed state, and wherein said second condition comprises a leaky CPV.

18. The evaporative emissions system of claim 17, wherein said first condition further comprises, responsive to a loading state of said vapor canister being above a threshold, opening said CPV and maintaining said CVV open such that air flow is directed from said canister adsorbent bed to said canister adsorbent buffer in order to purge desorbed vapors in said vapor canister to an intake manifold of an engine.

19. The evaporative emissions system of claim 17, wherein said second condition comprises an engine-off condition.

20. The evaporative emissions system of claim 15, wherein said first and second two-way valves are latchable.

* * * * *